US009777726B2

(12) United States Patent
Nagura et al.

(10) Patent No.: US 9,777,726 B2
(45) Date of Patent: Oct. 3, 2017

(54) COMPRESSOR WITH VALVE PRESSING PORTIONS FOR SEALING

(71) Applicant: Kobe Steel, Ltd., Kobe-shi (JP)

(72) Inventors: Kenji Nagura, Takasago (JP); Toshio Hirai, Takasago (JP); Hitoshi Takagi, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 526 days.

(21) Appl. No.: 14/244,133

(22) Filed: Apr. 3, 2014

(65) Prior Publication Data

US 2014/0314604 A1 Oct. 23, 2014

(30) Foreign Application Priority Data

Apr. 23, 2013 (JP) ..... 2013-090654

(51) Int. Cl.
*F04B 53/10* (2006.01)
*F04B 39/10* (2006.01)
(Continued)

(52) U.S. Cl.
CPC ..... *F04B 53/1087* (2013.01); *F04B 39/10* (2013.01); *F04B 39/121* (2013.01); *F04B 39/122* (2013.01); *F04B 39/14* (2013.01)

(58) Field of Classification Search
CPC ..... F04B 53/1097; F04B 53/10; F04B 53/22; F04B 53/16; F04B 53/162; F04B 53/007;
(Continued)

(56) References Cited

U.S. PATENT DOCUMENTS 3,854,735 A * 12/1974 Maurer ..... F16J 15/166 277/638
4,239,124 A * 12/1980 Inouye ..... F16J 15/48 220/240
(Continued)

FOREIGN PATENT DOCUMENTS

EP 1 950 472 A1 7/2008
JP 62-17381 A 1/1987
(Continued)

OTHER PUBLICATIONS

Extended European Search Report issued on Sep. 12, 2014 in the corresponding European Application No. 14163485.7.

*Primary Examiner* — Theodore Stigell
*Assistant Examiner* — Jon Hoffmann
(74) *Attorney, Agent, or Firm* — Oblon, McClelland, Maier & Neustadt, L.L.P.

(57) ABSTRACT

In order to prevent the leakage of a gas from an internal space communicating with a compression chamber inside a cylinder in a cylinder head of a compressor, the compressor includes a suction valve pressing portion that presses a suction valve so that the suction valve provided in the internal space of the cylinder head does not slip off through a suction-side head opening, the suction valve pressing portion includes a suction valve pressing and inserting portion that is inserted into the cylinder head through the suction-side head opening, the outer peripheral surface of the suction valve pressing and inserting portion is provided with an annular suction valve pressing groove portion, a suction-side O-ring is attached into the suction valve pressing groove portion, and a suction-side backup ring that suppresses the movement of the suction-side O-ring toward the suction-side head opening is disposed at a position near
(Continued)

the suction-side head opening of the suction-side O-ring inside the suction valve pressing groove portion.

12 Claims, 7 Drawing Sheets

(51) Int. Cl.
*F04B 39/14* (2006.01)
*F04B 39/12* (2006.01)

(58) Field of Classification Search
CPC .. F04B 7/00; F04B 39/10; F04B 39/14; F04B 39/121; F04B 39/122; F04B 39/125; F16J 15/02; F16J 15/021; F16J 15/022; F16J 15/0887; F16K 27/0209
USPC ..... 417/454, 415, 567, 568; 277/637, 638, 277/639
See application file for complete search history.

(56) References Cited

U.S. PATENT DOCUMENTS 5,277,560 A * 1/1994 Ritchie ..... F04B 39/1033 137/852
5,567,121 A * 10/1996 Peterson ..... F04B 39/10 137/557
5,947,697 A * 9/1999 Morrison ..... F04B 39/1046 417/237
6,481,721 B1 * 11/2002 Mueller ..... C03B 37/01211 277/549
7,828,301 B2 * 11/2010 Briscoe ..... F16J 15/062 277/611
8,449,640 B2 * 5/2013 Protasiewicz ..... F16J 15/062 277/637
2001/0027106 A1 * 10/2001 Kito ..... H04W 40/02 455/453
2001/0032951 A1 10/2001 Stewart
2003/0205588 A1 * 11/2003 Lee Mainous ..... B05C 5/0225 222/504
2004/0191080 A1 * 9/2004 Weber ..... F04B 27/1081 417/269
2004/0234403 A1 * 11/2004 Majerus ..... F04B 39/1066 417/569
2005/0008512 A1 * 1/2005 McGill ..... F04B 35/045 417/416
2006/0189208 A1 8/2006 Shaikh
2008/0168898 A1 * 7/2008 Hardin ..... F04B 39/02 92/153
2009/0123303 A1 * 5/2009 Ohnishi ..... F04B 39/14 417/270
2009/0145980 A1 * 6/2009 Jones ..... B05B 1/046 239/215
2009/0148322 A1 * 6/2009 Sakamoto ..... F04B 39/122 417/559
2010/0200490 A1 * 8/2010 Martin ..... B01D 29/114 210/232
2010/0229962 A1 * 9/2010 Frenzel ..... F16J 15/0887 137/315.19
2011/0210515 A1 9/2011 Sharp et al.
2011/0210516 A1 9/2011 Sharp et al.
2011/0293449 A1 * 12/2011 Shimizu ..... F04B 17/044 417/415
2013/0092023 A1 4/2013 Potter et al.

FOREIGN PATENT DOCUMENTS

JP 8-303591 11/1996
JP 11-315925 A 11/1999
JP 2009-62871 3/2009

* cited by examiner

COMPRESSOR WITH VALVE PRESSING PORTIONS FOR SEALING

BACKGROUND OF THE INVENTION

Field of the Invention

The present invention relates to a compressor.

Description of the Related Art

Hitherto, there has been known a compressor that compresses a gas to a high pressure.

For example, a compressor disclosed in JP 2009-62871 A is a compressor that compresses a hydrogen gas to an extreme pressure, and includes a piston (a plunger) that is formed in a straight rod shape, a cylinder that includes a hole portion into which the piston is inserted so as to be movable in a reciprocating manner in the axial direction, and a cylinder head (a head cover) that is attached to the front end of the cylinder head and includes therein a suction valve and a discharge valve. A compression chamber is formed in an area near the front end of the piston inside the hole portion of the cylinder. The cylinder head is provided with an internal space that communicates with the compression chamber and a suction port and a discharge port that communicate with the internal space. Further, the internal space of the cylinder head is provided with a valve that includes a suction valve and a discharge valve. When the piston moves toward the base end of the cylinder head, a gas is suctioned into the compression chamber through the suction port and the suction valve, and the gas suctioned into the compression chamber is compressed by the movement of the piston toward the front end of the cylinder head. The compressed gas is discharged from the compression chamber to the outside through the discharge valve and the discharge port.

In JP 8-303591 A, an extreme-pressure fluid sealing device is provided in each of a fixed portion and a sliding portion of a cylinder end of a plunger pump. In the extreme-pressure fluid sealing device that is provided in the fixed portion, a penta ring that is formed of urethane rubber so as to have a pentagonal section, a packing ring that is formed of high-molecular polyethylene, and a backup ring that is formed of copper so as to have a trapezoid end surface are disposed from a high-pressure portion in an annular gap formed between an inner surface of a cylinder and an outer peripheral surface of a cylinder inner member of an adapter having an end fixed to the cylinder. In the extreme-pressure fluid sealing device provided in the sliding portion, a penta ring that is formed of urethane rubber so as to have a pentagonal end surface, a packing ring that is formed of high-molecular polyethylene, a backup ring that is formed of copper so as to have a trapezoid end surface, and a bottom ring that is formed of steel are disposed from a high-pressure portion in an annular gap formed between the inner surface of the cylinder and an outer peripheral surface of a plunger.

SUMMARY OF THE INVENTION

In order that the suction valve and the discharge valve are attached to and detached from the cylinder head, there is a case in which the compressor includes a suction-side opening portion that is used to insert the suction valve into the internal space of the cylinder head and a discharge-side opening portion that is used to insert the discharge valve into the internal space of the cylinder head. In this case, a corresponding valve is inserted into the internal space of the cylinder head through each opening portion, and a valve pressing portion is inserted into the cylinder head through the opening portion so as to prevent the valve from slipping off from the opening portion. Further, in such a configuration, since there is a concern in which a gas may leak from the internal space of the cylinder head to the outside through a gap between the inner surface of the cylinder head and the outer peripheral surface of the insertion portion inside the cylinder head of the valve pressing portion, an O-ring as a sealing member is fitted to the outside of the insertion portion of the valve pressing portion so as to suppress the leakage of the gas. The O-ring is attached into the annular groove portion provided in the outer peripheral surface of the insertion portion, and is disposed while contacting the inner surface of the cylinder head.

However, in this configuration, the O-ring is damaged by the repeated gas compressing operation in the compressor, and hence there is a concern in which a gas may leak from the internal space of the cylinder head.

Specifically, when the gas is compressed in the compression chamber, the pressure of the internal space of the cylinder head also becomes a high pressure, and hence a pressure difference occurs between the internal space of the cylinder head and the external space thereof. At this time, the O-ring is strongly pressed toward the opening portion of the cylinder head. As a result, the O-ring is deformed so as to enter a minute gap between the inner surface of the cylinder head and the outer peripheral surface of the portion located near the opening portion of the groove portion of the insertion portion from the inside of the annular groove portion. Whenever the gas is compressed repeatedly, the O-ring is deformed so as to enter the gap, so that the O-ring is damaged. As a result, the gap between the outer peripheral surface of the insertion portion of the valve pressing portion and the inner surface of the cylinder head is sealed incompletely, and hence a gas leaks from the internal space of the cylinder head.

In JP 8-303591 A, the number of components such as ring members like the penta ring or the packing ring is large, and hence the extreme-pressure fluid sealing device may not be easily assembled. Further, since the side surfaces of the ring members need to contact each other, the ring members need to be provided with high precision.

The present invention is made to solve the above-described problems, and an object thereof is to provide a compressor capable of preventing the leakage of a gas from an internal space of a cylinder head.

In order to attain the above-described object, the present invention provides a compressor that compresses a gas including: a cylinder that has a gas introduction compression chamber formed inside a front end thereof; a piston that is inserted into the cylinder and compresses a gas introduced into the compression chamber; a cylinder head that is attached to the front end of the cylinder and includes an internal space communicating with the compression chamber; a check valve that is provided in the internal space of the cylinder head; a valve pressing portion that presses the check valve so that the check valve does not slip off through an opening of the cylinder head connected to the internal space; and a head sealing portion that suppresses the leakage of the gas from the internal space of the cylinder head, wherein the valve pressing portion includes a valve pressing insertion portion that is inserted into the internal space of the cylinder head through the opening, wherein an annular valve pressing groove portion is formed in an outer peripheral surface of the valve pressing insertion portion, and wherein the head sealing portion includes a valve pressing O-ring that is attached into the valve pressing groove portion and seals a gap between the valve pressing insertion portion and an inner surface forming the internal space in the cylinder head, and a valve pressing backup ring that is disposed at a position on the side of the opening with respect to the valve pressing O-ring inside the valve pressing groove portion and suppresses the movement of the valve pressing O-ring toward the opening.

In the compressor, since the valve pressing backup ring that suppresses the movement of the valve pressing O-ring toward the opening of the cylinder head is provided inside the valve pressing groove portion provided in the outer peripheral surface of the valve pressing insertion portion, the valve pressing backup ring may suppress the valve pressing O-ring from being deformed to enter the narrow gap between the portion located on the opening side with respect to the valve pressing groove portion in the outer peripheral surface of the valve pressing insertion portion and the inner surface forming the internal space of the cylinder head even when a large pressure difference between the internal space of the cylinder head and the external space thereof acts on the valve pressing O-ring when the gas is compressed inside the compression chamber so that the pressure of the internal space of the cylinder head becomes a high pressure. As a result, it is possible to prevent the damage of the valve pressing O-ring caused when the valve pressing O-ring enters the gap and to prevent the leakage of the gas from the internal space of the cylinder head.

In the compressor, a side surface portion located on the side of the opening of the cylinder head in an inner surface of the valve pressing groove portion and an end surface of the valve pressing backup ring facing the side surface portion may be all formed in a tapered shape that increase in diameter as it goes toward the opening of the cylinder head.

According to this configuration, the tapered end surface of the valve pressing backup ring is pressed by the tapered side surface portion inside the valve pressing groove portion due to a pressure difference between the internal space of the cylinder head and the external space thereof, and hence the valve pressing backup ring is widened outward in the radial direction along the tapered side surface portion inside the valve pressing groove portion, thereby blocking the gap between the inner surface of the cylinder head and the portion located on the opening side with respect to the valve pressing groove portion in the outer peripheral surface of the valve pressing insertion portion. For this reason, it is possible to further reliably prevent the valve pressing O-ring from entering the gap. As a result, it is possible to further reliably prevent the leakage of the gas from the internal space of the cylinder head.

In the compressor, the valve pressing insertion portion may include a valve pressing insertion body in which an annular valve pressing groove concave portion is formed in an outer peripheral surface of a front end thereof and a valve pressing adapter which is separably coupled to the front end of the valve pressing insertion body, and the valve pressing adapter may include a valve pressing adapter outer peripheral portion that forms the valve pressing groove portion by covering the valve pressing groove concave portion from the front end side of the valve pressing insertion body while the valve pressing adapter is coupled to the front end of the valve pressing insertion body.

According to this configuration, the valve pressing O-ring and the valve pressing backup ring may be attached into the annular valve pressing groove portion in an order that the valve pressing adapter is separated from the valve pressing insertion body, the valve pressing backup ring and the valve pressing O-ring are attached to the valve pressing groove concave portion, and the valve pressing adapter is coupled to the front end of the valve pressing insertion body. For this reason, the valve pressing O-ring and the valve pressing backup ring may be easily attached into the valve pressing groove portion without extending the valve pressing O-ring and the valve pressing backup ring outward in the radial direction.

In this case, one of the valve pressing insertion body and the valve pressing adapter may include a valve pressing and coupling concave portion, and the other of the valve pressing insertion body and the valve pressing adapter may include a valve pressing and coupling convex portion that is press-inserted into the valve pressing and coupling concave portion.

According to this configuration, the valve pressing insertion body and the valve pressing adapter may be coupled to each other by a large coupling force by press-inserting the valve pressing and coupling convex portion into the valve pressing and coupling concave portion. For this reason, it is possible to prevent the valve pressing adapter from slipping off from the valve pressing insertion body in a state before the valve pressing insertion portion is press-inserted into the internal space of the cylinder head.

Furthermore, in this case, the valve pressing adapter may include a valve pressing adapter penetration hole that penetrates the valve pressing adapter in the press-insertion direction of the valve pressing and coupling convex portion with respect to the valve pressing and coupling concave portion, and at least a part of the valve pressing adapter penetration hole may be provided with a female screw portion.

According to this configuration, the valve pressing adapter may be separated from the valve pressing insertion body in a manner such that a separation bolt is threaded into the female screw portion of the valve pressing adapter penetration hole, the front end of the bolt collides with the valve pressing insertion body, and the bolt is further threaded. For this reason, the maintenance or the replacement of the valve pressing O-ring and the valve pressing backup ring may be performed by easily separating the valve pressing adapter from the valve pressing insertion body even when the valve pressing and coupling convex portion is press-inserted into the valve pressing and coupling concave portion so that the valve pressing insertion body and the valve pressing adapter are strongly coupled to each other.

Further, in this case, a space inside the valve pressing adapter penetration hole may form a part of a gas circulation path connected to the compression chamber.

According to this configuration, since the space inside the valve pressing adapter penetration hole may be used as a part of the circulation path for supplying the gas to the compression chamber, it is possible to prevent an increase in the size of the valve pressing adapter and to simplify the manufacturing process of the valve pressing adapter compared to the case where the valve pressing adapter penetration hole is formed in the valve pressing adapter so as to be separated from the gas circulation path.

In the compressor, the front end of the cylinder may be provided with a cylinder opening, the compressor may further include a cylinder sealing portion that suppresses the leakage of the gas from the compression chamber, the cylinder head may include a head inserting portion that is inserted into the cylinder through the cylinder opening, an annular head groove portion may be formed in an outer peripheral surface of the head inserting portion, and the cylinder sealing portion may include a head O-ring that is attached into the head groove portion and seals a gap between the head inserting portion and an inner surface forming a space for inserting the head inserting portion in the cylinder and a head backup ring that is disposed at a position near the cylinder opening of the head O-ring inside the head groove portion and suppresses the movement of the head O-ring toward the cylinder opening.

In this configuration, since the head backup ring that suppresses the movement of the head O-ring toward the cylinder opening is provided inside the head groove portion provided in the outer peripheral surface of the head inserting portion, the head backup ring may suppress a part of the head O-ring from being deformed to enter the narrow gap between the inner surface of the cylinder and the portion located the cylinder opening with respect to the head groove portion in the outer peripheral surface of the head inserting portion even when a large pressure difference between the compression chamber and the external space acts on the head O-ring when the gas is compressed inside the compression chamber. As a result, it is possible to prevent the damage of the head O-ring caused when the head O-ring enters the gap and to prevent the leakage of the gas from the compression chamber.

In this case, a side surface portion located near the cylinder opening in an inner surface of the head groove portion and an end surface of the head backup ring facing the side surface portion may be all formed in a tapered shape that increases in diameter as it goes toward the cylinder opening.

In this configuration, the head backup ring may further reliably prevent the head O-ring from entering the gap between the inner surface of the cylinder and the portion located near the cylinder opening with respect to the head groove portion in the outer peripheral surface of the head inserting portion due to the same reason as that of the configuration in which the end surface of the valve pressing backup ring and the side surface portion inside the valve pressing groove portion are formed in a tapered shape. As a result, it is possible to further reliably prevent the leakage of the gas from the compression chamber.

In the configuration in which the cylinder head includes the head inserting portion, the head inserting portion may include a head inserting body in which an annular head groove concave portion is formed in an outer peripheral surface of a front end thereof and a head adapter which is separably coupled to the front end of the head inserting body, and the head adapter may include a head adapter outer peripheral portion that forms the head groove portion by covering the head groove concave portion from the front end side of the head inserting body while the head adapter is coupled to the front end of the head inserting body.

According to this configuration, the head O-ring and the head backup ring may be easily attached into the head groove portion due to the same reason as that of the configuration in which the valve pressing groove concave portion is formed in the outer peripheral surface of the front end of the valve pressing insertion body and the valve pressing adapter includes the valve pressing adapter outer peripheral portion forming the valve pressing groove portion by covering the valve pressing groove concave portion from the front end side of the valve pressing insertion body.

In this case, the outer diameter of the head adapter and the inner diameter of the head adapter insertion portion of the cylinder may be larger than the inner diameter of the compression chamber.

In this configuration, since the inner diameter of the head adapter insertion portion of the cylinder is larger than the inner diameter of the compression chamber, a step is formed between the inner surface of the compression chamber and the inner surface of the head adapter insertion portion of the cylinder. For this reason, for example, when the piston is retracted toward the base end of the cylinder so that the pressure of the compression chamber becomes a low pressure, it is possible to prevent a problem in which the head adapter is separated from the head inserting body and enters the compression chamber by the step between the inner surface of the compression chamber and the inner surface of the head adapter insertion portion.

In the configuration in which the head inserting portion includes the head inserting body and the head adapter, one of the head inserting body and the head adapter may include a head coupling concave portion, and the other of the head inserting body and the head adapter may include a head coupling convex portion that is press-inserted into the head coupling concave portion.

According to this configuration, the head inserting body and the head adapter may be coupled to each other by a strong coupling force by press-inserting the head coupling convex portion into the head coupling concave portion. For this reason, it is possible to prevent the head adapter from being separated from the head inserting body in a state before the head inserting portion is inserted into the cylinder.

In this case, the head adapter may include a head adapter penetration hole that penetrates the head adapter in the press-insertion direction of the head coupling convex portion with respect to the head coupling concave portion, and at least a part of the head adapter penetration hole may be provided with a female screw portion.

According to this configuration, the maintenance or the replacement of the head O-ring and the head backup ring may be performed by easily separating the head adapter from the head inserting body even when the head coupling convex portion is press-inserted into the head coupling concave portion so that the head inserting body and the head adapter are strongly coupled to each other due to the same reason as that of the configuration in which the valve pressing adapter includes the valve pressing adapter penetration hole.

Furthermore, in this case, a space inside the head adapter penetration hole may form a part of a gas circulation path connected to the compression chamber.

According to this configuration, since the space inside the head adapter penetration hole may be used as a part of the circulation path for supplying the gas into the compression chamber, it is possible to prevent an increase in the size of the head adapter and to simplify the manufacturing process of the head adapter.

As described above, according to the present invention, it is possible to provide the compressor capable of preventing the leakage of the gas from the internal space of the cylinder head.

DESCRIPTION OF THE PREFERRED EMBODIMENTS

Figure 1:
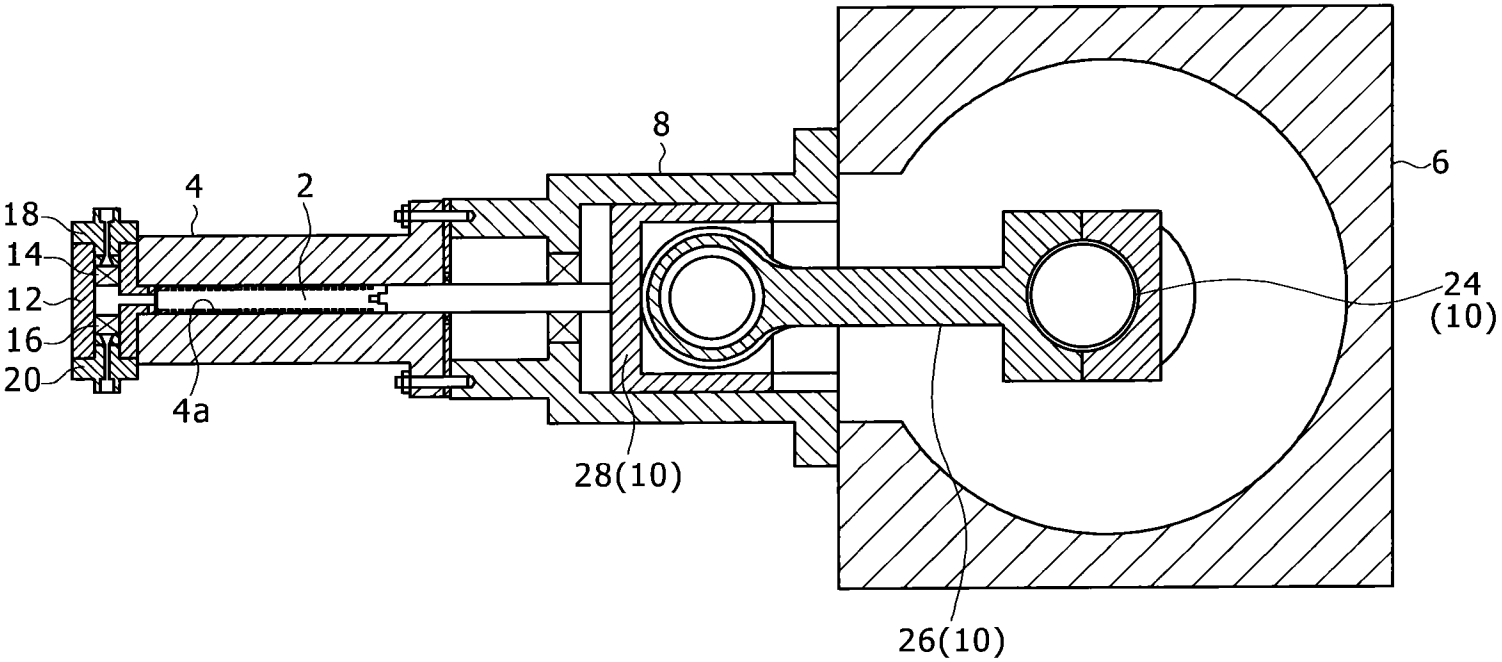
FIG. 1 is a longitudinal sectional view illustrating a compressor according to an embodiment of the present invention.

Hereinafter, an embodiment of the present invention will be described by referring to the drawings.

A compressor according to an embodiment of the present invention is a reciprocation type compressor that compresses a hydrogen gas by moving a piston 2 to be described later in a reciprocating manner and is particularly used to compress a hydrogen gas in a hydrogen station, which charges a hydrogen gas to a fuel-cell vehicle or the like, to an extreme pressure (several tens to several hundreds of MPa).

Figure 2:
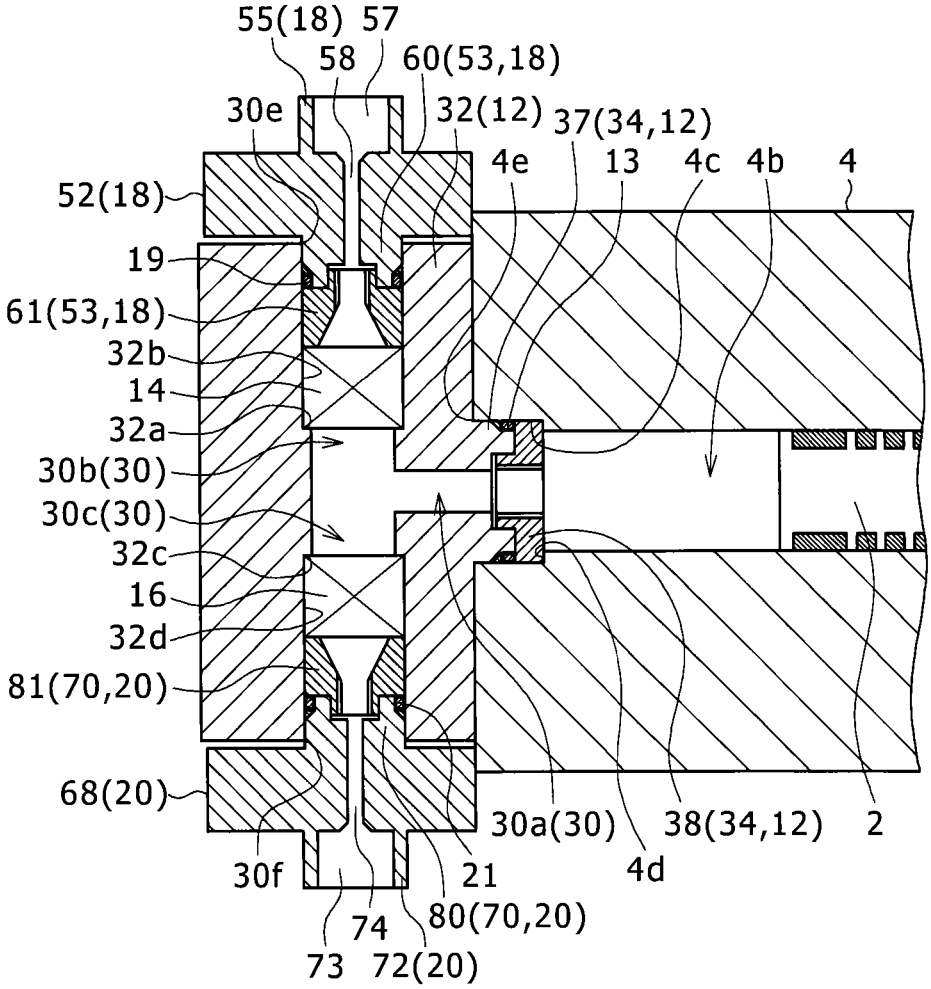
FIG. 2 is a partially enlarged view illustrating a front end of a cylinder of the compressor illustrated in FIG. 1 and a portion near a cylinder head.

As illustrated in FIG. 1, the compressor according to this embodiment includes the piston 2, a cylinder 4, an accommodation portion 6, a cross guide 8, a driving device 10, a cylinder head 12, a cylinder sealing portion 13 (see FIG. 2), a suction valve 14, a discharge valve 16, a suction valve pressing portion 18, a suction-side head sealing portion 19 (see FIG. 2), a discharge valve pressing portion 20, and a discharge-side head sealing portion 21 (see FIG. 2).

The piston 2 is a rod-shaped member, and is inserted into the cylinder 4. The piston 2 moves in a reciprocating manner so as to compress a hydrogen gas introduced into a compression chamber 4*b* (see FIG. 2) inside the cylinder 4.

The cylinder 4 is a substantially cylindrical member. The cylinder 4 is provided with a hole portion 4*a* that extends in the axial direction of the cylinder 4, and the piston 2 is inserted into the hole portion 4*a* so as to be movable in a reciprocating manner in the axial direction. The compression chamber 4*b* (see FIG. 2) into which the hydrogen gas is introduced is provided inside the front end of the cylinder 4, that is, an area on the front end side of the piston 2 in the hole portion 4*a*. Further, a cylinder fitting object portion 4*c* is provided in a portion on the front end side of the compression chamber 4*b* in the cylinder 4. The cylinder fitting object portion 4*c* communicates with the compression chamber 4*b*, and has an inner diameter larger than the inner diameter of the compression chamber 4*b*. For this reason, a step 4*d* is formed between the inner surface of the cylinder fitting object portion 4*c* and the inner surface of the compression chamber 4*b*. Further, the cylinder fitting object portion 4*c* is opened by a cylinder opening 4*e* that is formed in the front end surface of the cylinder 4.

The accommodation portion 6 is formed in a hollow shape as illustrated in FIG. 1, accommodates a crank shaft 24 to be described later of the driving device 10, and supports the crank shaft 24 so that the crank shaft 24 is rotatable.

The cross guide 8 is attached to the accommodation portion 6 while extending laterally from one side surface of the accommodation portion 6. The cross guide 8 is used to guide the movement of a cross head 28 to be described later of the driving device 10. The end of the cross guide 8 located at the opposite side to the accommodation portion 6 is connected to the base end (the end opposite to the front end) of the cylinder 4.

The driving device 10 includes a power transmission mechanism (not illustrated) that is disposed outside the accommodation portion 6, the crank shaft 24 that is accommodated inside the accommodation portion 6 and is rotated by the power transmitted from the power transmission mechanism, a connecting rod 26 of which one end is attached to the crank shaft 24, and the cross head 28 that is attached to the other end of the connecting rod 26 and is coupled to the base end of the piston 2. The connecting rod 26 extends from the inside of the accommodation portion 6 toward the cross guide 8, and the cross head 28 is accommodated inside the cross guide 8 while being movable in a reciprocating manner in the horizontal direction. The connecting rod 26 and the cross head 28 convert the rotational movement of the crank shaft 24 into the linear reciprocating movement, and transmit the linear reciprocating movement to the piston 2. Accordingly, the driving device 10 moves the piston 2 in a reciprocating manner in the axial direction.

The cylinder head 12 is separately attached to the front end of the cylinder 4. As illustrated in FIG. 2, the cylinder head 12 includes an internal space 30 that communicates with the compression chamber 4*b*. The internal space 30 includes a communication path 30*a*, a suction-side space 30*b*, and a discharge-side space 30*c*. The communication path 30*a* is connected to the compression chamber 4*b*, and extends from the end of the compression chamber 4*b* of the front end of the cylinder 4 toward the opposite side to the piston 2. The suction-side space 30*b* is connected to the end of the communication path 30*a* opposite to the compression chamber 4*b*, and extends toward one side (the upper side) in a direction perpendicular to the axial direction of the cylinder 4 (the extension direction of the hole portion 4*a*). The discharge-side space 30*c* extends toward the other side (the lower side) in a direction perpendicular to the axial direction of the cylinder 4. Further, the cylinder head 12 includes a head body 32 that contacts the front end surface of the cylinder 4 and a head inserting portion 34 that protrudes from the end surface of the head body 32 on the cylinder 4 side and is inserted into the cylinder fitting object portion 4*c* through the cylinder opening 4*e*.

The head body 32 is fastened to the cylinder 4 by a fastening member (not illustrated) while contacting the front end surface of the cylinder 4. The inside of the head body 32 is provided with the suction-side space 30*b*, the discharge-side space 30*c*, and a portion of the communication path 30*a* from the end opposite to the compression chamber 4*b* to the intermediate portion. The suction-side space 30*b* and the discharge-side space 30*c* are formed so as to be symmetrical to each other. The end surface (the upper surface) of the head body 32 provided with the suction-side space 30*b* is provided with a suction-side head opening 30*e* as an opening of the suction-side space 30*b*, and the end surface (the lower surface) of the head body 32 provided with the discharge-side space 30*c* is provided with a discharge-side head opening 30*f* as an opening of the discharge-side space 30*c*.

In the inner surface of the head body 32 forming the suction-side space 30*b*, the inner diameter of the range from the suction-side head opening 30*e* to a predetermined length is larger than the inner diameter of the remaining range, and a step 32*a* is formed between both ranges. A suction-side fitting object portion 32*b* is formed by a portion from the suction-side head opening 30*e* to the step 32*a* in the suction-side space 30*b*. Further, in the inner surface of the head body 32 forming the discharge-side space 30*c*, the inner diameter of the range from the discharge-side head opening 30*f* to a predetermined length is larger than the inner diameter of the remaining range, and a step 32*c* is formed between both ranges. A discharge-side fitting object portion 32*d* is formed by a portion from the discharge-side head opening 30*f* to the step 32*c* in the discharge-side space 30*c*.

Figure 3:
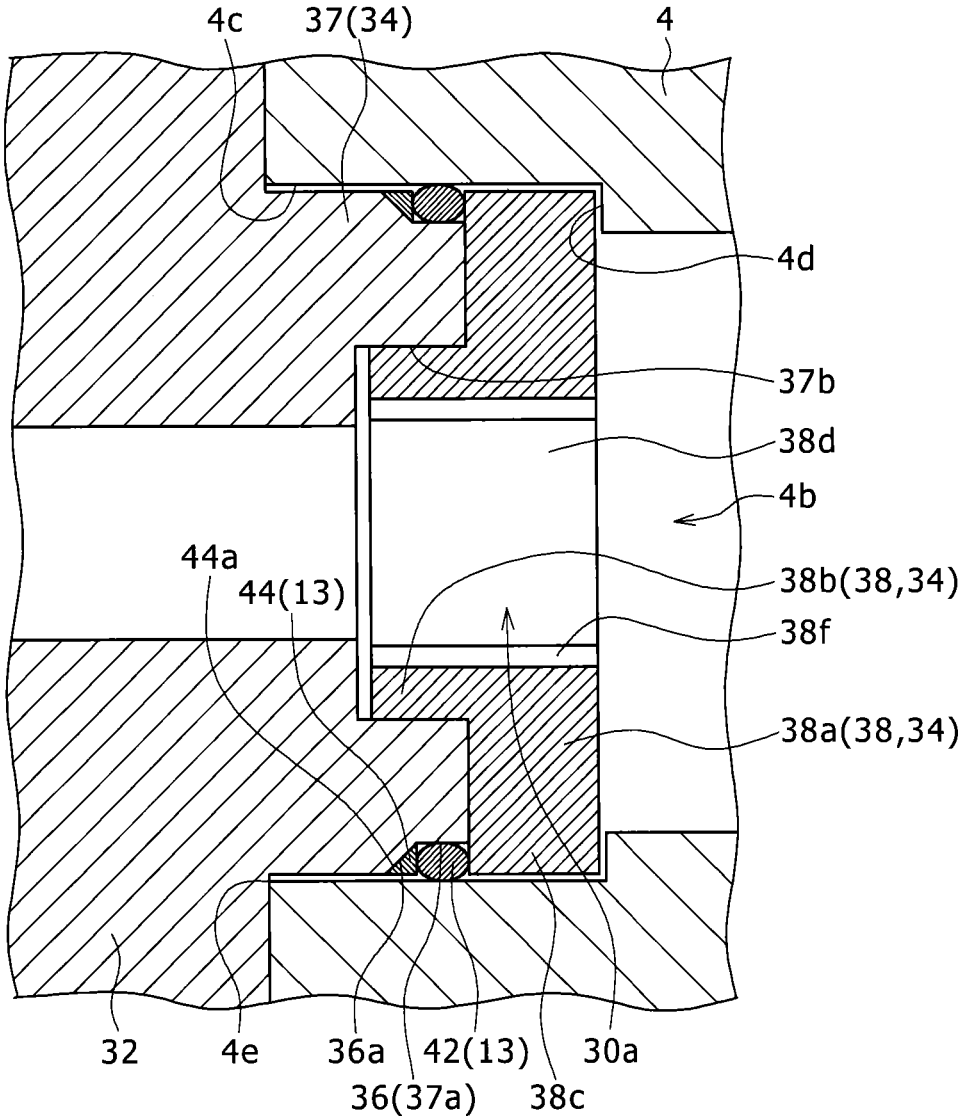
FIG. 3 is a further enlarged view illustrating the vicinity of a head inserting portion of the cylinder head of FIG. 2.

The head inserting portion 34 is formed in a substantially columnar shape that has an outer diameter larger than the inner diameter of the compression chamber 4*b* and is slightly smaller than the inner diameter of the cylinder fitting object portion 4*c*. The outer peripheral surface of the head inserting portion 34 is provided with an annular head groove portion 36 (see FIG. 3) that extends in the circumferential direction of the outer peripheral surface. In the inner surface of the head groove portion 36, a side surface portion 36*a* that is located at the cylinder opening 4*e* side (at the opposite side to the compression chamber 4*b*) is formed in a tapered shape that increases in diameter as it goes toward the cylinder opening 4*e*. The head inserting portion 34 includes a head inserting body 37 and a head adapter 38. Inside the head adapter 38, a portion extending from the intermediate portion of the communication path 30*a* in the longitudinal direction to the end connected to the compression chamber 4*b* is formed so as to extend in the axial direction of the head adapter 38.

The head inserting body 37 is a portion that is integrally formed with the head body 32 so as to protrude from the end surface of the cylinder 4 side of the head body 32. The outer peripheral portion of the front end (the end opposite to the head body 32) of the head inserting body 37 is provided with a head groove concave portion 37*a* as an annular concave portion. Further, the head inserting body 37 includes a head coupling concave portion 37*b* as a concave portion that is recessed from the front end surface toward the head body 32.

The head adapter 38 is separably coupled to the head inserting body 37 in the axial direction of the head inserting portion 34. The head adapter 38 includes a head adapter body 38*a* that has an outer diameter equal to the outer diameter of the portion other than the front end provided with the head groove concave portion 37*a* of the head inserting body 37, and a head coupling convex portion 38*b* that protrudes from the head adapter body 38*a* and is press-inserted into the head coupling concave portion 37*b*. When the head coupling convex portion 38*b* is press-inserted into the head coupling concave portion 37*b*, the head adapter 38 is strongly coupled to the head inserting body 37. Further, the outer peripheral portion of the head adapter body 38*a* forms a head adapter outer peripheral portion 38*c*. The head adapter outer peripheral portion 38*c* forms the head groove portion 36 in a manner such that the head groove concave portion 37*a* is covered from the front end side of the head inserting body 37 while the head adapter 38 is coupled to the front end of the head inserting body 37.

Further, the head adapter 38 includes a head adapter penetration hole 38*d* that penetrates the head adapter 38 in the press-insertion direction (the axial direction of the head inserting portion 34) of the head coupling convex portion 38*b* with respect to the head coupling concave portion 37*b*. The head adapter penetration hole 38*d* penetrates the head adapter body 38*a* and the head coupling convex portion 38*b*. A female screw portion 38*f* is formed in the entire portion from one end of the head adapter penetration hole 38*d* to the other end thereof in the axial direction. The space inside the head adapter penetration hole 38*d* is connected to the compression chamber 4*b*, and forms a part of the communication path 30*a* as the circulation path for the hydrogen gas supplied to the compression chamber 4*b*.

The cylinder sealing portion 13 is used to suppress the leakage of the hydrogen gas from the compression chamber 4*b* at the front end of the cylinder 4. The cylinder sealing portion 13 includes a head O-ring 42 and a head backup ring 44.

The head O-ring 42 is formed in an annular shape using elastic rubber, and is fitted to the outside of the head inserting portion 34 while being attached into the head groove portion 36. The outer peripheral portion of the head O-ring 42 contacts the inner surface of the cylinder 4 forming the cylinder fitting object portion 4*c*. The head O-ring 42 is used to seal a gap formed between the outer peripheral surface of the head inserting portion 34 and the inner surface of the cylinder 4 forming the cylinder fitting object portion 4*c*. By the head O-ring 42, it is possible to suppress the leakage of the hydrogen gas from the compression chamber 4*b* to the external space through the gap between the outer peripheral surface of the head inserting portion 34 and the inner surface of the cylinder 4.

Figure 6:
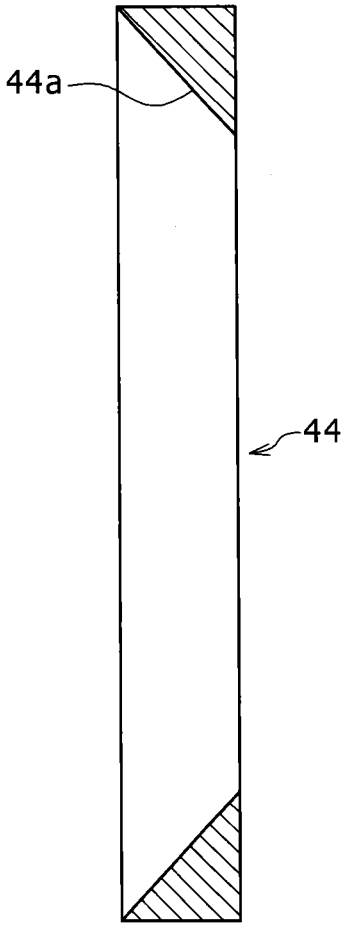
FIG. 6 is a cross-sectional view taken along the direction perpendicular to the axial direction of a head backup ring according to the embodiment of the present invention.

The head backup ring 44 is formed in an annular shape using metal, and is fitted to the outside of the head inserting portion 34 while being disposed at the position on the cylinder opening 4*e* side (the opposite side to the compression chamber 4*b*) with respect to the head O-ring 42 inside the head groove portion 36. The head backup ring 44 is used to suppress the movement of the head O-ring 42 toward the cylinder opening 4*e*. The head backup ring 44 includes an end surface (an inner surface) 44*a* that faces the side surface portion 36*a* inside the head groove portion 36, and an end surface 44*a* is formed in a tapered shape that increases in diameter as it goes toward the cylinder opening 4*e* (see FIG. 6).

As illustrated in FIG. 2, the suction valve 14 is accommodated inside the suction-side fitting object portion 32*b* of the head body 32 and is disposed while contacting the step 32*a*. The suction valve 14 is a check valve that allows the circulation of the hydrogen gas from a suction port 57 to be described later toward the compression chamber 4*b* (toward the communication path 30*a*) and suppresses the circulation of the hydrogen gas from the compression chamber 4*b* toward the suction port 57. The suction valve 14 suppresses the reverse flow of the compressed hydrogen gas toward the suction port 57 when the compressed hydrogen gas is discharged from the compression chamber 4*b*.

The discharge valve 16 is accommodated inside the discharge-side fitting object portion 32*d* of the head body 32 and is disposed while contacting the step 32*c*. The discharge valve 16 is a check valve that allows the circulation of the hydrogen gas from the compression chamber 4*b* (the communication path 30*a*) toward ejection discharge port 73 to be described later and suppresses the circulation of the hydrogen gas from the discharge port 73 toward the compression chamber 4*b*. The discharge valve 16 suppresses the reverse flow of the gas from the outside toward the compression chamber 4*b* (toward the communication path 30*a*) through the discharge port 73 when the hydrogen gas is suctioned to the compression chamber 4*b*.

The suction valve pressing portion 18 is separably attached to the head body 32. The suction valve pressing portion 18 is used to press and fix the suction valve 14 so that the suction valve 14 does not slip off to the outside from the suction-side fitting object portion 32*b* inside the head body 32 through the suction-side head opening 30*e*. The suction valve pressing portion 18 includes a suction valve pressing flange 52 that is disposed at the outside of the end surface of the head body 32 provided with the suction-side head opening 30*e*, and a suction valve pressing and inserting portion 53 that protrudes from the end surface of the suction valve pressing flange 52 near the head body 32 and is inserted into the suction-side fitting object portion 32*b* through the suction-side head opening 30*e*.

The suction valve pressing flange 52 is fastened to the head body 32 by a fastening member (not illustrated) while the suction valve 14 is interposed between the front end of the suction valve pressing and inserting portion 53 and the step 32*a*. Accordingly, the suction valve 14 is fixed to the inside of the suction-side fitting object portion 32*b*, and the suction valve pressing portion 18 is fixed to the head body 32.

The end surface of the suction valve pressing flange 52 opposite to the head body 32 is provided with a suction-side protrusion portion 55, and the hydrogen gas suction port 57 is formed inside the suction-side protrusion portion 55. The inside of the suction valve pressing flange 52 and the inside of the suction valve pressing and inserting portion 53 are provided with a suction path 58 connected to the suction port 57. The end of the suction path 58 opposite to the suction port 57 is connected to a portion of the suction-side space 30*b* located on the communication path 30*a* side in relation to the step 32*a* through the suction valve 14.

The suction valve pressing and inserting portion 53 is formed in a substantially columnar shape that an outer diameter larger than the diameter of the inner surface of the head body 32 forming a portion located near the communication path 30*a* in relation to the step 32*a* of the suction-side space 30*b* and slightly smaller than the diameter of the inner surface forming the suction-side fitting object portion 32*b*. The outer peripheral surface of the suction valve pressing and inserting portion 53 is provided with an annular suction valve pressing groove portion 56 (see FIG. 4) that extends in the circumferential direction of the outer peripheral surface. In the inner surface of the suction valve pressing groove portion 56, the side surface portion 56*a* that is located on the suction-side head opening 30*e* side is formed in a tapered shape that increases in diameter as it goes toward the suction-side head opening 30*e*. The suction valve pressing and inserting portion 53 includes a suction valve pressing and inserting body 60 and a suction valve pressing adapter 61.

Figure 4:
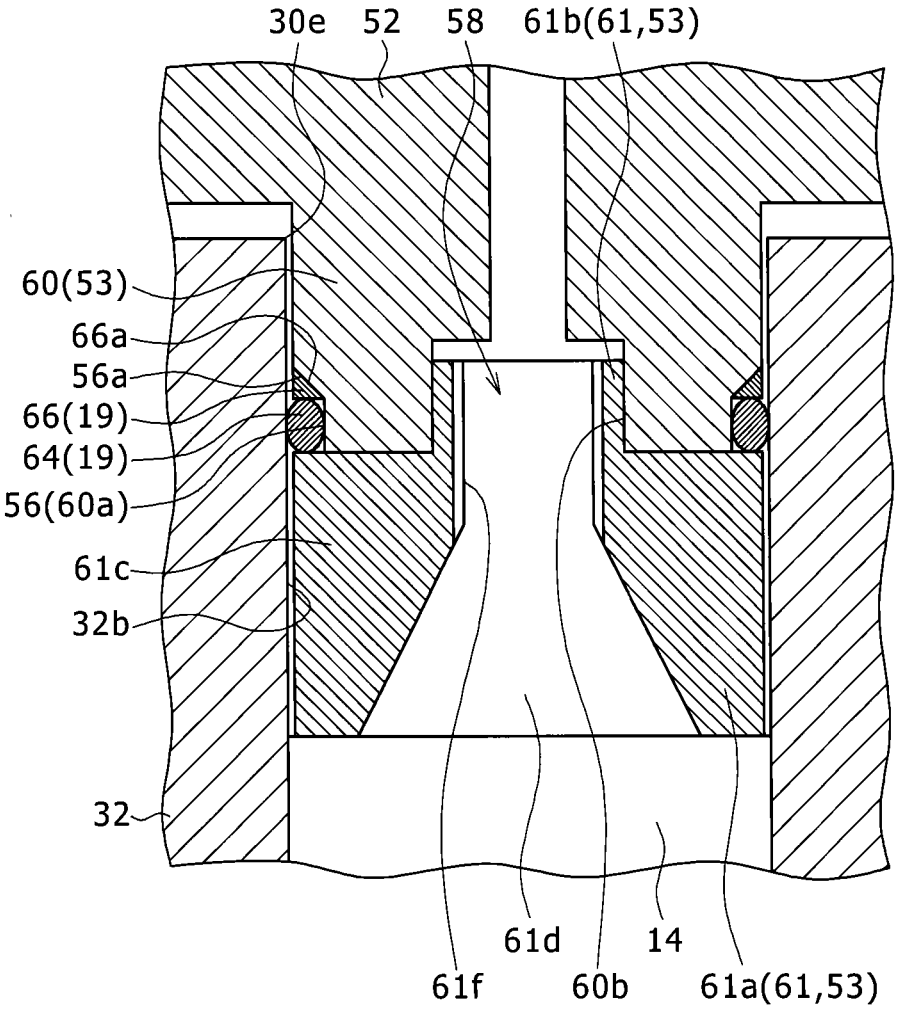
FIG. 4 is a further enlarged view illustrating the vicinity of a suction valve pressing and inserting portion of FIG. 2.

The suction valve pressing and inserting body 60 is a portion that is integrally formed with the suction valve pressing flange 52 so as to protrude from the end surface of the head body 32 side of the suction valve pressing flange 52. As illustrated in FIG. 4, the outer peripheral portion of the front end (the end opposite to the suction valve pressing flange 52) of the suction valve pressing and inserting body 60 is provided with a concave portion for suction valve pressing groove 60*a* as an annular concave portion. Further, the suction valve pressing and inserting body 60 includes a concave portion for suction valve pressing portion coupling 60*b* as a concave portion that is recessed from the front end surface toward the suction valve pressing flange 52.

The suction valve pressing adapter 61 is separably coupled to the suction valve pressing and inserting body 60 in the axial direction of the suction valve pressing and inserting portion 53. The suction valve pressing adapter 61 includes a suction-side adapter body 61*a* that has an outer diameter equal to the outer diameter of the portion other than the concave portion for suction valve pressing groove 60*a* of the suction valve pressing, and inserting body 60 and a convex portion for suction valve pressing portion coupling 61*b* that protrudes from the suction-side adapter body 61*a* and is press-inserted into the concave portion for suction valve pressing portion coupling 60*b*. When the convex portion for suction valve pressing portion coupling 61*b* is press-inserted into the concave portion for suction valve pressing portion coupling 60*b*, the suction valve pressing adapter 61 is strongly coupled to the suction valve pressing and inserting body 60. Further, a suction-side adapter outer peripheral portion 61*c* is formed by the outer peripheral portion of the suction-side adapter body 61*a*. The suction-side adapter outer peripheral portion 61*c* forms the suction valve pressing groove portion 56 in a manner such that the concave portion for suction valve pressing groove 60*a* is covered from the front end side of the suction valve pressing and inserting body 60 while the suction valve pressing adapter 61 is coupled to the front end of the suction valve pressing and inserting body 60.

Further, the suction valve pressing adapter 61 is provided with a suction-side adapter penetration hole 61*d* that penetrates the suction valve pressing adapter 61 in the press-insertion direction of the convex portion for suction valve pressing portion coupling 61*b* (the axial direction of the suction valve pressing and inserting portion 53) with respect to the concave portion for suction valve pressing portion coupling 60*b*. The suction-side adapter penetration hole 61*d* penetrates the suction-side adapter body 61*a* and the suction valve pressing and coupling convex portion 61*b*. In the suction-side adapter penetration hole 61*d*, a portion extending from the front end surface of the convex portion for suction valve pressing portion coupling 61*b* to the intermediate portion of the suction valve pressing adapter 61 in the axial direction is provided with a female screw portion 61*f*. The space inside the suction-side adapter penetration hole 61*d* forms a part of the suction path 58.

The suction-side head sealing portion 19 is used to suppress the leakage of the hydrogen gas from the internal space 30 of the cylinder head 12 through the suction-side head opening 30*e*. The suction-side head sealing portion 19 includes a suction-side O-ring 64 and a suction-side backup ring 66. The suction-side O-ring 64 is an example of the valve pressing O-ring of the present invention, and the suction-side backup ring 66 is an example of the valve pressing backup ring of the present invention.

The suction-side O-ring 64 basically has the same configuration as that of the head O-ring 42, and the suction-side backup ring 66 basically has the same configuration as that of the head backup ring 44.

Specifically, the suction-side O-ring 64 is fitted to the outside of the suction valve pressing and inserting portion 53 while being attached into the suction valve pressing groove portion 56. The outer peripheral portion of the suction-side O-ring 64 contacts the inner surface of the head body 32 forming the suction-side fitting object portion 32*b*. The suction-side O-ring 64 seals a gap between the outer peripheral surface of the suction valve pressing and inserting portion 53 and the inner surface of the head body 32 forming the suction-side fitting object portion 32*b* so as to suppress the leakage of the hydrogen gas through the gap.

Further, the suction-side backup ring 66 is fitted to the outside of the suction valve pressing and inserting portion 53 while being disposed at the position on the suction-side head opening 30*e* side (near the suction valve pressing flange 52) with respect to the suction-side O-ring 64 inside the suction valve pressing groove portion 56. The suction-side backup ring 66 is used to suppress the movement of the suction-side O-ring 64 toward the suction-side head opening 30*e*. The suction-side backup ring 66 includes an end surface (an inner surface) 66*a* facing the side surface portion 56*a* inside the suction valve pressing groove portion 56, and the end surface 66*a* is formed in a tapered shape that increases in diameter as it goes toward the suction-side head opening 30*e*.

As illustrated in FIG. 2, the discharge valve pressing portion 20 presses the discharge valve 16 so that the discharge valve 16 does not slip off to the outside from the discharge-side fitting object portion 32*d* inside the cylinder head 12 through the discharge-side head opening 30*f*. The discharge valve pressing portion 20 has the same configuration as that of the suction valve pressing portion 18, and is disposed so as to be symmetrical with respect to the suction valve pressing portion 18 in the vertical direction.

The discharge valve pressing portion 20 includes a discharge valve pressing flange 68 that is the same as the suction valve pressing flange 52, a discharge valve pressing and inserting portion 70 that is the same as the suction valve pressing and inserting portion 53, and a discharge-side protrusion portion 72 that is the same as the suction-side protrusion portion 55. The discharge-side protrusion portion 72 is provided with the hydrogen gas discharge port 73. The inside of the discharge valve pressing flange 68 and the inside of the discharge valve pressing and inserting portion 70 are provided with a discharge path 74 connected to the discharge port 73. The structure of the discharge port 73 is the same as the structure of the suction port 57, and the structure of the discharge path 74 is the same as the structure of the suction path 58.

The discharge valve pressing flange 68 is fastened to the head body 32 by a fastening member (not illustrated) while the discharge valve pressing and inserting portion 70 is inserted into the discharge-side fitting object portion 32*d* through the discharge-side head opening 30*f* and the discharge valve 16 is interposed between the front end of the discharge valve pressing and inserting portion 70 and the step 32*c*. Accordingly, the discharge valve 16 is fixed to the inside of the discharge-side fitting object portion 32*d*, and the discharge valve pressing portion 20 is fixed to the head body 32.

Figure 5:
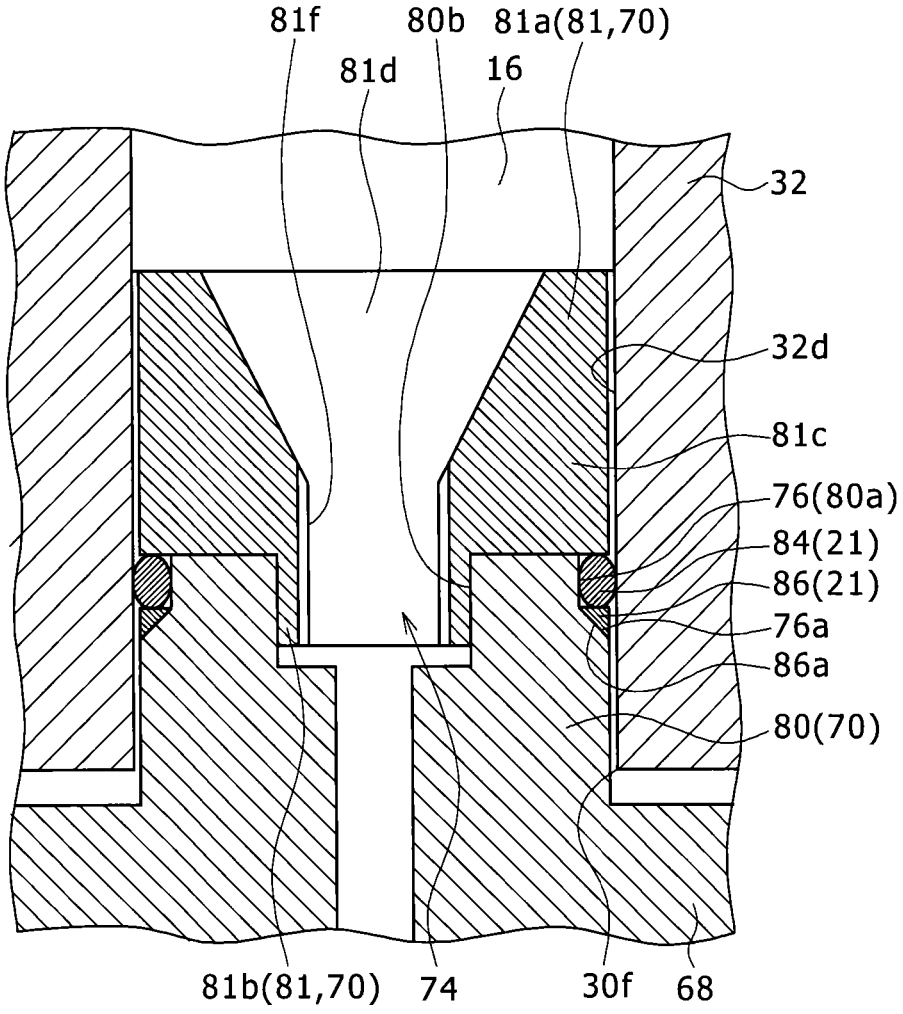
FIG. 5 is a further enlarged view illustrating the vicinity of a discharge valve pressing and inserting portion of FIG. 2.

Further, as illustrated in FIG. 5, the outer peripheral surface of the discharge valve pressing and inserting portion 70 is provided with a discharge valve pressing groove portion 76 that is the same as the suction valve pressing groove portion 56. The inner surface of the discharge valve pressing groove portion 76 includes a tapered side surface portion 76*a* that is the same as the side surface portion 56*a* inside the suction valve pressing groove portion 56.

The discharge valve pressing and inserting portion 70 includes a discharge valve pressing and inserting body 80 that is the same as the suction valve pressing and inserting body 60, and a discharge valve pressing adapter 81 that is the same as the suction valve pressing adapter 61. Further, the discharge valve pressing and inserting body 80 is provided with a discharge valve pressing groove concave portion 80*a* that is the same as the concave portion for suction valve pressing groove 60*a*, and a discharge valve pressing portion coupling concave portion 80*b* that is the same as the concave portion for suction valve pressing portion coupling 60*b*.

The discharge valve pressing adapter 81 includes a discharge-side adapter body 81*a* that is the same as the suction-side adapter body 61*a*, and a discharge valve pressing portion coupling convex portion 81*b* that is the same as the convex portion for suction valve pressing portion coupling 61*b*. When the discharge valve pressing portion coupling convex portion 81*b* is press-inserted into the discharge valve pressing portion coupling concave portion 80*b*, the discharge valve pressing adapter 81 is strongly coupled to the discharge valve pressing and inserting body 80. Further, the discharge-side adapter body 81*a* is provided with a discharge-side adapter outer peripheral portion 81*c* that is the same as the suction-side adapter outer peripheral portion 61*c*. Further, the discharge-side pressing adapter 81 is provided with a discharge-side adapter penetration hole 81*d* that is the same as the suction-side adapter penetration hole 61*d*. The inner surface of the discharge-side adapter penetration hole 81*d* is provided with a female screw portion 81*f* that is the same as the female screw portion 61*f* of the suction-side adapter penetration hole 61*d*.

The discharge-side head sealing portion 21 is used to suppress the leakage of the hydrogen gas from the internal space 30 of the cylinder head 12 through the discharge-side head opening 30*f*. The discharge-side head sealing portion 21 has the same configuration as that of the suction-side head sealing portion 19 except that the discharge-side head sealing portion is disposed so as to be symmetrical to the suction-side head sealing portion 19 in the vertical direction. Specifically, the discharge-side head sealing portion 21 includes a discharge-side O-ring 84 that is the same as the suction-side O-ring 64, and a discharge-side backup ring 86 that is the same as the suction-side backup ring 66. The discharge-side O-ring 84 is an example of the valve pressing O-ring of the present invention, and the discharge-side backup ring 86 is an example of the valve pressing backup ring of the present invention.

The discharge-side O-ring 84 is attached into the discharge valve pressing groove portion 76 in the same manner such that the suction-side O-ring 64 is attached into the suction valve pressing groove portion 56. The discharge-side O-ring 84 seals a gap between the outer peripheral surface of the discharge valve pressing and inserting portion 70 and the inner surface of the head body 32 forming the discharge-side fitting object portion 32*d* so as to suppress the leakage of the hydrogen gas through the gap.

Further, the discharge-side backup ring 86 is disposed at the position on the discharge-side head opening 30*f* side with respect to the discharge-side O-ring 84 inside the discharge valve pressing groove portion 76 and suppresses the movement of the discharge-side O-ring 84 toward the discharge-side head opening 30*f*. Further, the discharge-side backup ring 86 includes an end surface (an inner surface) 86*a* facing the side surface portion 76*a* inside the discharge valve pressing groove portion 76, and the end surface 86*a* is formed in a tapered shape as in the end surface 66*a* of the suction-side backup ring 66.

In the compressor of this embodiment with such a configuration, the crank shaft 24 rotates about its axis when power is transmitted from a power transmission mechanism (not illustrated) to the crank shaft 24 (see FIG. 1). The rotational movement of the crank shaft 24 is converted into the linear reciprocating movement by the connecting rod 26 and the cross head 28, and the linear reciprocating movement is transmitted to the piston 2. Accordingly, the piston 2 moves in a reciprocating manner in the axial direction.

When the piston 2 moves toward the crank shaft 24, the hydrogen gas is suctioned into the head body 32 through the suction port 57 (see FIG. 2) and the suction path 58, passes through the suction valve 14, and is introduced into the compression chamber 4*b* through the communication path 30*a*. The hydrogen gas that is introduced into the compression chamber 4*b* is compressed to an extreme pressure in a manner such that the piston 2 moves toward the front end of the cylinder 4 (toward the cylinder head 12). The compressed hydrogen gas passes from the compression chamber 4*b* through the communication path 30*a* and then through the discharge valve 16, and is discharged to the outside through the discharge path 74 and the discharge port 73.

Figure 7:
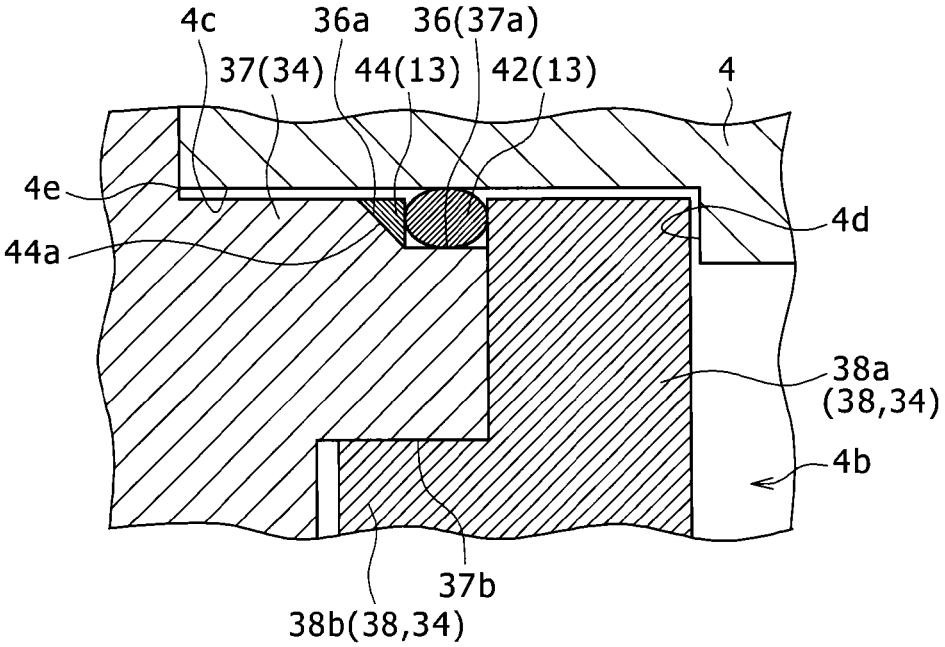
FIG. 7 is a partially enlarged view illustrating a state where the head backup ring blocks a gap between an outer peripheral surface of a head inserting portion and an inner surface of a cylinder fitting object portion.

Since the pressure of the compression chamber 4*b* becomes an extreme pressure when the hydrogen gas is compressed and a large pressure difference occurs between the compression chamber 4*b* and the external space, a force acting toward the cylinder opening 4*e* is exerted on the head O-ring 42 (see FIG. 3) and the head backup ring 44. At this time, the tapered end surface 44*a* of the head backup ring 44 is pressed by the tapered side surface portion 36*a* inside the head groove portion 36, so that the head backup ring 44 is slightly widened outward in the radial direction along the side surface portion 36*a*. Accordingly, as illustrated in FIG. 7, the head backup ring 44 blocks a minute gap between a portion located on the cylinder opening 4*e* side with respect to the head groove portion 36 in the outer peripheral surface of the head inserting portion 34 and the inner surface of the cylinder 4 forming the cylinder fitting object portion 4*c*. At the same time, the head backup ring 44 suppresses the movement of the head O-ring 42 toward the cylinder opening 4*e*. As a result, it is possible to suppress the head O-ring 42 from being deformed to enter the gap between the portion located on the cylinder opening 4*e* side with respect to the head groove portion 36 in the outer peripheral surface of the head inserting portion 34 and the inner surface of the cylinder 4 forming the cylinder fitting object portion 4*c*. For this reason, in this embodiment, the damage of the head O-ring 42 may be prevented. As a result, the leakage of the hydrogen gas from the compression chamber 4*b* caused by the damage of the head O-ring 42 may be prevented.

Further, since the pressure of the internal space 30 of the cylinder head 12 connected to the compression chamber 4*b* also becomes a high pressure when the hydrogen gas is compressed, a force acting toward the suction-side head opening 30*e* is exerted on the suction-side O-ring 64 (see FIG. 4) and the suction-side backup ring 66, and a force acting toward the discharge-side head opening 30*f* is exerted on the discharge-side O-ring 84 (see FIG. 5) and the discharge-side backup ring 86. At this time, the tapered end surface 66*a* (see FIG. 4) of the suction-side backup ring 66 is pressed by the tapered side surface portion 56*a* of the suction valve pressing groove portion 56 so that the suction-side backup ring 66 is slightly widened outward in the radial direction. At the same time, the tapered end surface 86*a* (see FIG. 5) of the discharge-side backup ring 86 is pressed by the tapered side surface portion 76*a* of the discharge valve pressing groove portion 76 so that the discharge-side backup ring 86 is slightly widened outward in the radial direction. As a result, as in the case of the head O-ring 42, it is possible to suppress the suction-side O-ring 64 from being deformed to enter the minute gap between the portion located on the suction-side head opening 30*e* side with respect to the suction valve pressing groove portion 56 in the outer peripheral surface of the suction valve pressing and inserting portion 53 and the inner surface of the head body 32 forming the suction-side fitting object portion 32*b*. At the same time, it is possible to suppress the discharge-side O-ring 84 from being deformed to enter the minute gap between the portion located on the discharge-side head opening 30*f* side with respect to the discharge valve pressing groove portion 76 in the outer peripheral surface of the discharge valve pressing and inserting portion 70 and the inner surface of the head body 32 forming the discharge-side fitting object portion 32*d*. For this reason, in this embodiment, it is possible to prevent the damage of the suction-side O-ring 64 and the discharge-side O-ring 84. As a result, it is possible to prevent the leakage of the hydrogen gas from the internal space 30 of the cylinder head 12 caused by the damage of the suction-side O-ring 64 and the discharge-side O-ring 84.

Further, in this embodiment, since the step 4*d* (see FIG. 2) is formed between the inner surface forming the cylinder fitting object portion 4*c* in the front end of the cylinder 4 and the inner surface forming the compression chamber 4*b*, the step 4*d* may suppress a problem in which the head adapter 38 is separated from the head inserting body 37 and enters the compression chamber 4*b* when the piston 2 is retracted toward the crank shaft 24 (see FIG. 1) so that the pressure of the compression chamber 4*b* becomes a low pressure.

Further, in this embodiment, when the suction-side O-ring 64 (see FIG. 4) and the suction-side backup ring 66 are attached into the suction valve pressing groove portion 56, the suction-side backup ring 66 and the suction-side O-ring 64 are attached to the concave portion for suction valve pressing groove 60*a* from the front end side of the suction valve pressing and inserting body 60 while the suction valve pressing adapter 61 is separated from the suction valve pressing and inserting body 60. Subsequently, the convex portion for suction valve pressing portion coupling 61*b* is press-inserted into the concave portion for suction valve pressing portion coupling 60*b* so that the suction valve pressing and inserting body 60 is coupled to the suction valve pressing adapter 61. The inner diameter of the suction-side O-ring 64 and the inner diameter of the suction-side backup ring 66 are smaller than the outer diameter of the suction-side adapter outer peripheral portion 61*c*. However, according to this embodiment, the suction-side O-ring 64 and the suction-side backup ring 66 may be easily attached into the suction valve pressing groove portion 56 without extending the suction-side O-ring 64 and the suction-side backup ring 66 outward in the radial direction.

Further, in this embodiment, as in the case of the suction-side O-ring 64 and the suction-side backup ring 66, the discharge-side O-ring 84 (see FIG. 5) and the discharge-side backup ring 86 are attached to the discharge valve pressing groove portion 76, and the head O-ring 42 (see FIG. 3) and the head backup ring 44 are attached to the head groove portion 36. For this reason, the discharge-side O-ring 84 and the discharge-side backup ring 86 may be easily attached to the discharge valve pressing groove portion 76, and the head O-ring 42 and the head backup ring 44 may be easily attached to the head groove portion 36.

Further, in this embodiment, since the suction valve pressing and inserting body 60 (see FIG. 4) and the suction valve pressing adapter 61 are strongly coupled to each other by press-inserting the convex portion for suction valve pressing portion coupling 61*b* into the concave portion for suction valve pressing portion coupling 60*b*, it is possible to prevent the suction valve pressing adapter 61 from being separated from the suction valve pressing and inserting body 60 in the state before the suction valve pressing and inserting portion 53 is inserted into the suction-side fitting object portion 32*b*. For the same reason, it is possible to prevent the discharge valve pressing and inserting body 80 from being separated from the discharge valve pressing adapter 81 in the state before the discharge valve pressing and inserting portion 70 (see FIG. 5) is inserted into the discharge-side fitting object portion 32*d*, and to prevent the head inserting body 37 from being separated from the head adapter 38 in the state before the head inserting portion 34 (see FIG. 3) is inserted into the cylinder fitting object portion 4*c*.

Further, in this embodiment, when the replacement and the maintenance of the suction-side O-ring 64 (see FIG. 4) and the suction-side backup ring 66 are performed, the suction valve pressing portion 18 (see FIG. 2) is separated from the head body 32, the suction valve pressing adapter 61 is separated from the suction valve pressing and inserting body 60 (see FIG. 4), and then the suction-side O-ring 64 and the suction-side backup ring 66 are separated from the concave portion for suction valve pressing groove 60*a*. Since the suction valve pressing and inserting body 60 and the suction valve pressing adapter 61 are strongly coupled to each other by press-inserting the convex portion for suction valve pressing portion coupling 61*b* into the concave portion for suction valve pressing portion coupling 60*b*, it is difficult to separate the suction valve pressing adapter 61 from the suction valve pressing and inserting body 60 just by holding and pulling the suction valve pressing and inserting body. Therefore, in this embodiment, a separation bolt is threaded into the female screw portion 61*f* of the suction-side adapter penetration hole 61*d* from the front end side of the suction valve pressing and inserting portion 53, and the bolt is further threaded after the front end of the bolt collides with the suction valve pressing and inserting body 60, thereby separating the suction valve pressing adapter 61 from the valve pressing insertion body 60. For this reason, the maintenance or the replacement of the suction-side O-ring 64 and the suction-side backup ring 66 may be easily performed by easily separating the suction valve pressing adapter 61 from the suction valve pressing and inserting body 60 even when the suction valve pressing and inserting body 60 and the suction valve pressing adapter 61 are strongly coupled to each other.

Further, in this embodiment, the replacement and the maintenance of the discharge-side O-ring 84 (see FIG. 5) and the discharge-side backup ring 86 and the replacement and the maintenance of the head O-ring 42 (see FIG. 3) and the head backup ring 44 may be performed as in the case of the suction-side O-ring 64 and the suction-side backup ring 66. For this reason, the maintenance or the replacement of the discharge-side O-ring 84 and the discharge-side backup ring 86 may be performed by easily separating the discharge valve pressing adapter 81 from the discharge valve pressing and inserting body 80 even when the discharge valve pressing and inserting body 80 and the discharge valve pressing adapter 81 are strongly coupled to each other. Further, the maintenance or the replacement of the head O-ring 42 and the head backup ring 44 may be performed by easily separating the head adapter 38 from the head inserting body 37 even when the head inserting body 37 and the head adapter 38 are strongly coupled to each other.

Further, in this embodiment, since the space inside the suction-side adapter penetration hole 61*d* (see FIG. 4) is used as a part of the hydrogen gas suction path 58, it is possible to prevent an increase in the size of the suction valve pressing adapter 61 and to simplify the manufacturing process of the suction valve pressing adapter 61 compared to the case where the penetration hole 61*d* is formed in the suction valve pressing adapter 61 so as to be separated from the suction path 58. Similarly, since the space inside the discharge-side adapter penetration hole 81*d* (see FIG. 5) is used as a part of the hydrogen gas discharge path 74, it is possible to prevent an increase in the size of the discharge valve pressing adapter 61 and to simplify the manufacturing process of the discharge valve pressing adapter 61 compared to the case where the penetration hole 81*d* is formed in the discharge valve pressing adapter 61 so as to be separated from the discharge path 74. Further, since the space inside the head adapter penetration hole 38*d* (see FIG. 3) is used as a part of the communication path 30*a* for supplying the hydrogen gas to the compression chamber 4*b*, it is possible to prevent an increase in the size of the head adapter 38 and to simplify the manufacturing process of the head adapter 38 compared to the case where the penetration hole 38*d* is formed in the head adapter 38 so as to be separated from the communication path 30*a*.

In the compressor of this embodiment, since there is no need to process the O-rings 42, 64, and 84 in accordance with the shape of the peripheral member, the commercial O-rings may be used.

Furthermore, it should be understood that the embodiment disclosed herein is merely an example and does not limit the present invention. The scope of the present invention is expressed by the claims instead of the description of the above-described embodiment, and further includes the meaning equivalent to claims and all modifications within the scope.

For example, in the above-described embodiment, the compressor compressing the hydrogen gas has been exemplified, but the present invention may be also applied to a compressor that compresses a gas other than the hydrogen gas.

Further, the configurations of the head inserting portion and the cylinder sealing portion of the above-described embodiment may be omitted. For example, in a case where the groove portion cylinder head and the front end of the cylinder are integrally formed with each other, the head inserting portion and the cylinder sealing portion are not needed and hence may be omitted.

Figure 8:
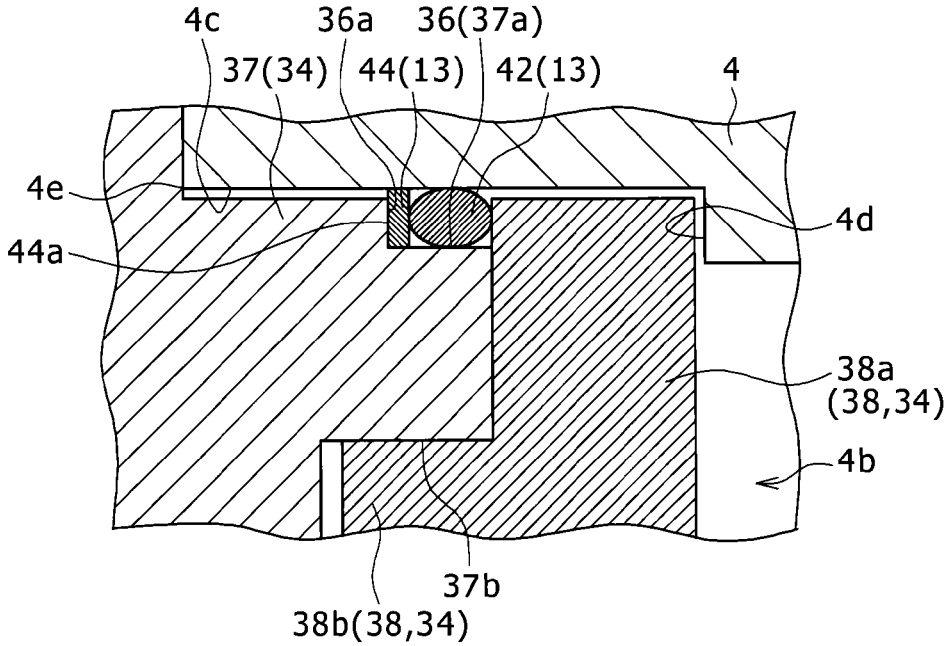
FIG. 8 is a view corresponding to FIG. 7 illustrating the vicinity of a head backup ring according to a modified example of the embodiment of the present invention.

Further, the tapered side surface portion inside each groove portion and the tapered end surface of each backup ring may be formed in the other shape. For example, as in the modified example illustrated in FIG. 8, the side surface portion 36*a* of the cylinder opening 4*e* side inside the head groove portion 36 and the end surface 44*a* facing the side surface portion 36*a* in the head backup ring 44 may be formed in a plane perpendicular to the axial direction of the head inserting portion 34 (the axial direction of the cylinder 4). Similarly, the side surface portion of the suction-side head opening side inside the suction valve pressing groove portion and the end surface of the suction-side backup ring facing the side surface portion may be formed in a plane perpendicular to the axial direction of the suction valve pressing and inserting portion. Further, the side surface portion of the discharge-side head opening side inside the discharge valve pressing groove portion and the end surface of the discharge-side backup ring facing the side surface portion may be formed in a plane perpendicular to the axial direction of the discharge valve pressing and inserting portion.

Further, the female screw portion may be formed throughout the suction-side adapter penetration hole and the discharge-side adapter penetration hole in the axial direction. Further, the female screw portion may be partially formed in the head adapter penetration hole in the axial direction.

Further, the method of coupling the suction valve pressing and inserting body to the suction valve pressing adapter, the method of coupling the discharge valve pressing and inserting body to the discharge valve pressing adapter, and the method of coupling the head inserting body to the head adapter are not limited to the above-described press-inserting. For example, a configuration may be employed in which the male screw is formed in one convex portion of each insertion body and each corresponding adapter, the female screw is formed in the other concave portion, and the male screw of the convex portion is threaded into the female screw of the concave portion so that each insertion body is coupled to each corresponding adapter. Further, each insertion body and each corresponding adapter may be disposed inside the corresponding fitting object portion while simply abutting against each other in the axial direction of the insertion portion without being fixed to each other.

What is claimed is:

1. A compressor comprising:

a cylinder that has a gas compression chamber formed inside a front end thereof;

a piston that is provided in the cylinder and compresses a gas introduced into the compression chamber;

a cylinder head that is attached to the front end of the cylinder, and is formed with an internal space communicating with the compression chamber and having an end opening;

a check valve that is provided in the internal space of the cylinder head;

a valve pressing portion that pressingly keeps the check valve from moving out of the end opening of the cylinder head; and a head sealing portion that prevents the leakage of the gas from the internal space of the cylinder head, wherein the valve pressing portion includes a valve pressing insertion portion that lies in the internal space of the cylinder head, the valve pressing portion having:

an insertion body, and an adapter separably coupled to a front end of the insertion body to define an annular groove portion in an outer peripheral surface of the valve pressing insertion portion, the adapter coming into contact with the check valve in an axial direction of the internal space, and wherein the head sealing portion includes an O-ring that is attached into the annular groove portion and seals a gap between the valve pressing insertion portion and an inner surface of the cylinder head, and a backup ring that is disposed between the O-ring and the insertion body inside the annular groove portion, to thereby suppress movement of the O-ring toward the end opening.

2. The compressor according to claim 1, wherein the annular groove portion has a contact surface coming into contact with an end surface of the backup ring, the contact surface being tapered so that the diameter of the insertion body increases as advancing toward the end opening of the cylinder head, whereby the diameter of the backup ring increases in response to an increased pressure of the gas in the internal space of the cylinder head.

3. The compressor according to claim 1, wherein the front end of the cylinder has a cylinder opening, the cylinder head includes a head inserting portion inserted into the cylinder through the cylinder opening, and an annular head groove portion formed in an outer peripheral surface of the head inserting portion, further comprising a cylinder sealing portion for preventing the leakage of the gas from the compression chamber, wherein the cylinder sealing portion includes a head O-ring that is attached into the head groove portion and seals a gap between the head inserting portion and an inner surface of the cylinder, and a head backup ring that is disposed between the head O-ring and the head inserting portion inside the head groove portion to thereby suppress the movement of the head O-ring toward the cylinder opening.

4. The compressor according to claim 3, wherein the head groove portion has a contact surface coming into contact with an end surface of the head backup ring, the contact surface being tapered so that the diameter of the head inserting portion increases as advancing toward the cylinder opening, whereby the diameter of the head backup ring increases in response to an increased pressure of the gas in the internal space of the cylinder head.

5. The compressor according to claim 3, wherein the head inserting portion includes a head inserting body and a head adapter separably coupled to the head inserting body to define an annular head groove portion in an outer peripheral surface of a front end thereof, and wherein the head adapter includes a head adapter outer peripheral portion that defines the annular head groove portion, and the head adapter is coupled to the front end of the head inserting body.

6. The compressor according to claim 5, wherein the outer diameter of the head adapter and the inner diameter of the head adapter insertion portion of the cylinder are larger than the inner diameter of the compression chamber.

7. The compressor according to claim 5, wherein one of the head inserting body and the head adapter includes a head coupling concave portion, and the other includes a head coupling convex portion pressingly coupled into the head coupling concave portion.

8. The compressor according to claim 7, wherein the head adapter includes a head adapter penetration hole that penetrates the head adapter in the press-insertion direction of the head coupling convex portion with respect to the head coupling concave portion, and wherein at least a part of the head adapter penetration hole is provided with a female screw portion.

9. The compressor according to claim 8, wherein the head adapter penetration hole defines a part of a gas circulation path connected to the compression chamber.

10. The compressor according to claim 1, wherein one of the insertion body and the adapter includes a coupling concave portion, and the other includes a coupling convex portion pressingly coupled in the coupling concave portion.

11. The compressor according to claim 10, wherein the adapter includes a penetration hole that penetrates the adapter in the press-insertion direction of the coupling convex portion with respect to the coupling concave portion, and wherein at least a part of the penetration hole is provided with a female screw portion.

12. The compressor according to claim 11, wherein the penetration hole defines a part of a gas circulation path connected to the compression chamber.

* * * * *